United States Patent [19]

Fleischmann et al.

[11] 3,976,183

[45] Aug. 24, 1976

[54] TYPEWRITER RIBBON SUPPLY ADAPTER FOR REPLACEABLE RIBBONS

[75] Inventors: Lester K. Fleischmann, Highland Park; William J. Kenney, Villa Park; David L. Fleischmann, Northbrook, all of Ill.

[73] Assignee: Standard Manifold Company, Chicago, Ill.

[22] Filed: Feb. 18, 1975

[21] Appl. No.: 550,547

[52] U.S. Cl. ..... 197/151; 197/170

[51] Int. Cl.[2] ..... B41J 35/28

[58] Field of Search ..... 197/151, 153, 170

[56] References Cited

UNITED STATES PATENTS

| | | | |
|---|---|---|---|
| 1,944,023 | 1/1934 | Ford | 197/151 X |
| 2,825,450 | 3/1958 | Lambert | 197/151 |
| 2,900,067 | 8/1959 | England | 197/151 |
| 3,190,430 | 6/1965 | McGrath | 197/151 |
| 3,349,887 | 10/1967 | Goff | 197/151 |
| 3,682,407 | 8/1972 | Lichtenstein et al. | 197/151 |
| 3,702,652 | 11/1972 | Hengelhaupt et al. | 197/151 |
| 3,710,915 | 1/1973 | Teichmann et al. | 197/151 |
| 3,731,781 | 5/1973 | Candill et al. | 197/151 |
| 3,882,989 | 5/1975 | Morelli | 197/151 |
| 3,889,795 | 6/1975 | Garberi et al. | 197/151 |

*Primary Examiner*—Edgar S. Burr
*Assistant Examiner*—William Pieprz
*Attorney, Agent, or Firm*—Wegner, Stellman, McCord, Wiles & Wood

[57] ABSTRACT

An adapter permits replaceable inked ribbons to be used in a typewriter that is constructed to receive ribbon cartridges. Such a typewriter has means to removably retain a cartridge in place, and the adapter has a base plate that is engaged by said means. A transparent cover member which is spaced above the baseplate is hinged close to the plane of the baseplate so it swings forwardly as it is opened. A manually rotatable ribbon advance knob is rotatably mounted in the cover member and drivingly engages a ribbon take-up spool, preferably through a one-way clutch that prevents reverse rotation of the spool. For those typewriters which have a vertically movable control member to adjust the ribbon advance for total release ribbon or plastic matrix ribbon, the base plate carries a manually pivotable control member actuator.

17 Claims, 7 Drawing Figures

TYPEWRITER RIBBON SUPPLY ADAPTER FOR REPLACEABLE RIBBONS

BACKGROUND OF THE INVENTION

Various typewriters are particularly constructed to take a sealed ribbon supply cartridge that contains a ribbon supply spool and a ribbon take-up spool with a run of ribbon that extends exteriorly of the cartridge between the two spools so that it may be engaged in the ribbon guides of the typewriter. The ribbons in such cartridges are single pass ribbons, and the cartridge structure makes them relatively expensive to use. An example of such a typewriter is disclosed in U.S. Pat. No. 3,604,549.

Further, as taught in U.S. Pat. No. 3,604,549 some typewriters have a ribbon advance which is adjustable for use either with a total release ribbon or with a ribbon of the solvent coated plastic transfer matrix type such as that disclosed and claimed in U.S. Pat. No. 3,413,184. The first type of ribbon prints satisfactorily only if there is no overstriking of a previously printed area; whereas, in the case of the plastic transfer matrix ribbon, limited overlapping is permissible. The mechanism disclosed and claimed in U.S. Pat. No. 3,604,549 provides a simple means for adjusting the ribbon advance by means of a vertically movable control member which is spring biased to an elevated position in which the ribbon advance moves the ribbon each time a character is printed. Depressing the control member changes the ribbon advance mechanism to provide the limited overstriking that is permissible with the plastic transfer matrix type ribbon.

As taught in U.S. Pat. No. 3,604,549, the cartridge for the total release ribbon does not touch the vertically movable control member; while the cartridge for the plastic transfer matrix ribbon is built with internal means which depresses the ribbon advance control member when the cartridge is mounted upon the typewriter.

SUMMARY OF THE INVENTION

The principal object of the present invention is to provide an adapted which can be mounted upon a typewriter of the type heretofore described in the place normally occupied by a ribbon cartridge, and which is constructed to accommodate replaceable ribbons to eliminate the relatively great expense involved in the use of ribbon cartridges.

Another object of the invention is to provide an adapter which is readily attached to or detached from a typewriter in the same way that the cartridges are attached and detached.

Yet another object of the invention is to provide an adapter having a hinged cover which swings forwardly to expose the entire area of a base plate upon which the ribbon supply spool and the ribbon take-up spool are supported when they are on the typewriter supply spindle and take-up spindle, respectively.

Still another object of the invention is to provide an adapter in which the cover is provided with a rotatable, manual ribbon advance member which drivingly interengages with a ribbon take-up spool that is supported upon the adapter base plate surrounding the typewriter take-up spindle. In one embodiment there is a one-way clutch between the manually rotatable member and the spool to prevent reverse rotation of the spool.

Still another object of the invention is to provide an adapter having a manually pivotable actuator for the vertically movable control member disclosed in U.S. Pat. No. 3,604,549. The actuator has one position in which it is alongside the vertically movale control member and another position in which it overlies the control member and depresses it to its position that adjusts the typewriter ribbon advance for the use of plastic transfer matrix ribbon.

Still another object of the invention is to provide an adapter which has a transparent cover member so that a person using the typewriter may see whether or not the ribbon is feeding properly and may see how much ribbon has been used and wound onto the take-up spool.

THE DRAWINGS

DETAILED DESCRIPTION OF THE INVENTION

Figure 1:
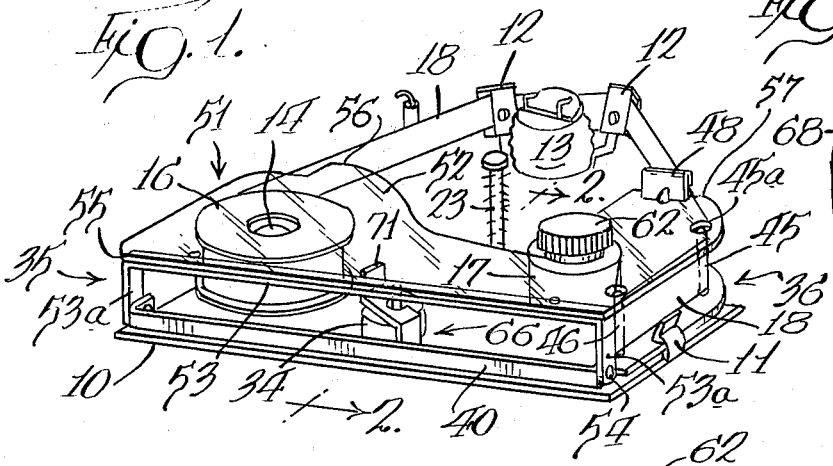
FIG. 1 is a perspective view of a first embodiment of the adapter of the present invention with related portions of a typewriter illustrating the position that the adapter occupies with respect thereto.

For pertinent parts of the mechanism of a typical typewriter with which the ribbon adapter of the present invention may be used, reference is made to U.S. Pat. Nos. 3,604,549 and 3,731,781. Only so much of that typewriter mechanism as is necessary for an understanding of the present invention is illustrated in FIGS. 1 and 2 of the drawings.

A typewriter has a mounting plate 10 at the ends of which are releasable retaining means which may conveniently take the form of clips such as the clip 11. To the rear of the mounting plate 10 are ribbon guides 12 which flank the ball 13 that carries all the characters.

The typewriter has a supply spindle 14 (FIG. 1) and a take-up spindle 15 (FIG. 2) upon which are rotatably mounted, respectively, a ribbon supply spool 16 and ribbon take-up spool 17. A typewriter ribbon 18 which may be either of the total release type or of the plastic transfer matrix type is originally wound upon the supply spool 16 and during use passes through the ribbon guides 12 and is wound onto the take-up spool 17.

Figure 2:
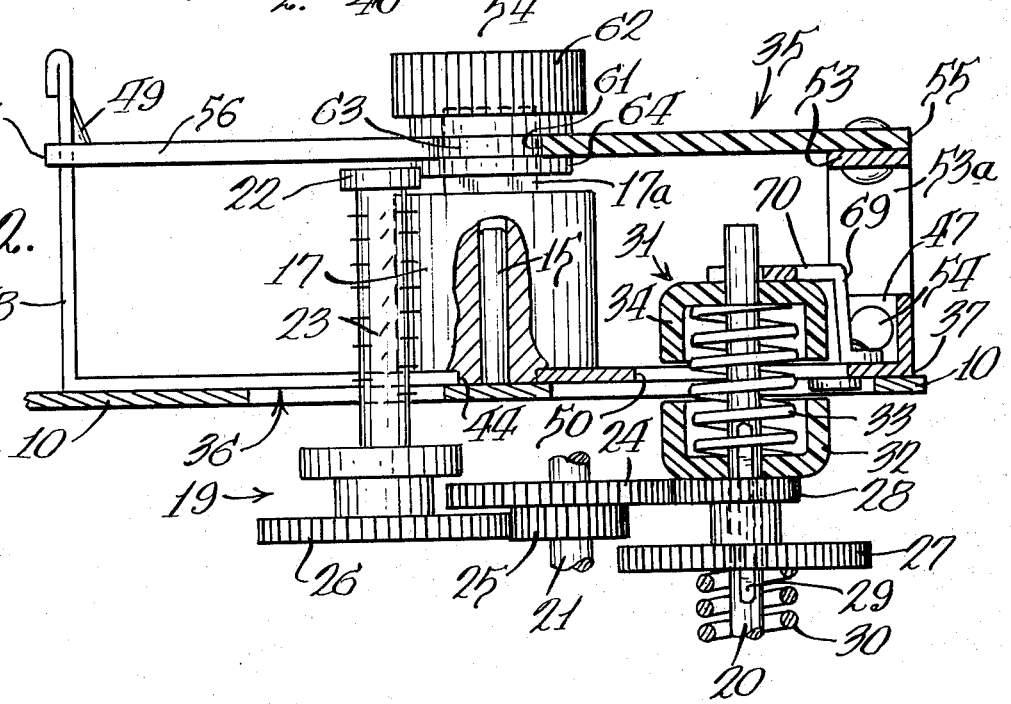
FIG. 2 is a sectional view on an enlarged scale taken substantially as indicated along the line 2—2 of FIG. 1.

Insofar as the present invention is concerned, the pertinent parts of the typewriter ribbon advance mechanism are indicated generally at 19 in FIG. 2. The ribbon advance, or drive mechanism 19 includes an input shaft 20, an intermediate shaft 21, and a drive shaft 22 which carries a drive roller 23 that has spines penetrating the ribbon 18 from its outer surface where it winds around the take-up spool 17. Thus, rotation of the roller 23 is what causes the ribbon to be reeled off of the supply spool 16 and onto the take-up spool 17; and as the amount of ribbon on the take-up spool increases, the shaft 22 carrying the drive roller 23 swings in an arcuate path about the center of the intermediate shaft 21.

Keyed to the intermediate shaft 21 are a gear 24 and a pinion 25, and the pinion 25 meshes with a gear 26 at the lower end of the drive shaft 22. The different drives for the roller 23 are accomplished by change gears 27 and 28 on the drive shaft 20 which are longitudinally slidable on the shaft along a spline 29. A spring 30 surrounds the shaft 20 below the gear 27 and biases the gears 27 and 28 to an elevated position (not shown) in which the gear 27 meshes with the pinion 25 and the gear 28 is above the gear 24. In that position the ribbon advance is adjusted for use with a total release ribbon.

Ribbon advance control means, indicated generally at 31, includes a spring cup 32 that surrounds the shaft 20 above the pinion 28, a compression spring 33 seated in the cup, and a spring cap 34. Pressure exerted upon the spring cap 34 is applied through the spring 33 and spring cup 32 to the pinion 28, and is sufficient to overcome the bias of the spring 30 and move the change gears so that the pinion 28 is meshed with the gear 24, and the gear 27 is below the pinion 25, as shown in FIG. 2 of the drawings.

The detailed description up to this point is of those components of the typewriter of patent 3,604,549 with which the adapter of the present invention cooperates. The balance of the present disclosure is directed to the adapter of the invention, which in the first embodiment, is indicated generally at 35, in the precise form that it takes when constructed for use with said typewriter. It will be obvious from the detailed description of the adapter that with appropriate relatively minor modifications of shape, dimensions, and location of holes and openings it can be constructed for use with other typewriters that ordinarily are used with ribbon supply cartridges.

The adapter 35 includes a base plate 36 that has a front edge 37, a rear margin 38, and ends 39. An upturned stiffening flange 40 extends along the front edge 37 of the base plate 36; and the two ends 39 of the base plate are provided with upwardly struck bosses 41 with which the latch fingers 11 of the typewriter mounting plate 10 engage when the adapter is mounted upon a typewriter.

The base plate 36 has an opening 42 to receive the supply spool spindle 14 of the typewriter. It also has an elongate opening 43 which extends inwardly from the rear margin 38 of the base plate 36 and terminates in an end portion 44 which is impaled by the typewriter take-up spindle 15. The elongate portion of the opening 43 accommodates the ribbon advance drive roller 23 as it moves about the axis of the shaft 21 when ribbon is would onto the take-up spool 17.

The base plate 36 is also provided with ribbon guide means in the form of upright pins 45 and 46 which are fixed in an end portion of the base plate where they are adjacent a take-up spool 17 when the latter is mounted upon the typewriter take-up spindle 15 as illustrated in FIGS. 1 and 2. Also at the two ends 39 of the base plate, close to the front edge 37, are short, upturned ears 47; and at the rear margin 38 behind the end portion 44 of the elongate slot 43 is an upstanding finger 48 having a detent 49 which functions as a latch. A second opening 50 in the central area of the base plate 36 close to the front edge 37 receives the ribbon advance control means 31.

Figure 3:
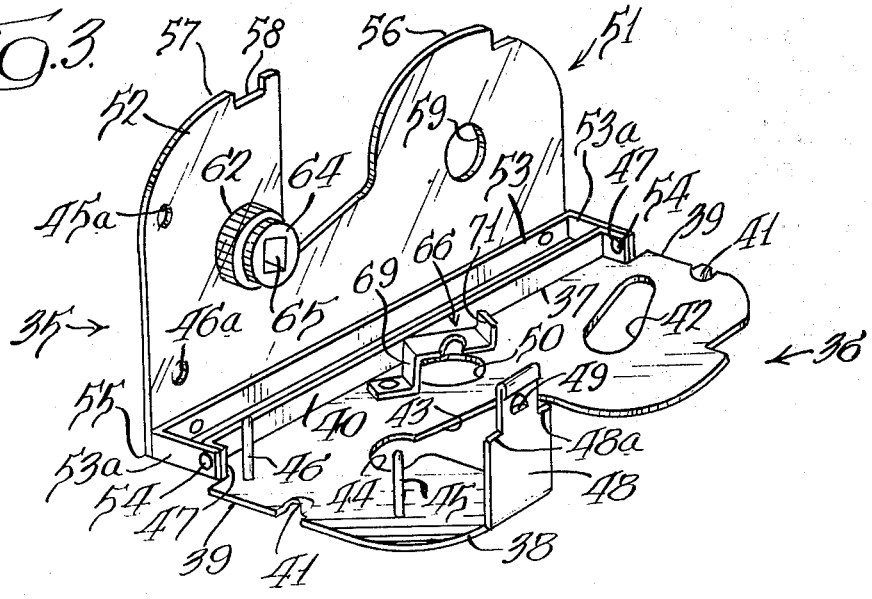
FIG. 3 is a perspective view of the first embodiment removed from a typewriter, with the cover member open and the actuator for the ribbon advance control member in the same position that it is occupying in FIGS. 1 and 2.

An adapter cover member, indicated generally at 51, consists of a transparent plastic plate 52 which is riveted to a transverse front bar 53 that has downturned supporting fingers **53*a* at its two ends that are pivotally connected to the ears 47 by means of loose rivets 54. The ears 47, fingers 53 and rivets 54 provide hinge means which mount the cover member 51 for swinging movement between an operating position illustrated in FIGS. 1 and 2, and an open position illustrated in FIG. 3. As best seen in FIG. 3, the fingers 53 are substantially longer than the ears 47, which places the transverse pivot axis for the cover member 51 close to the base plate 36 so that, when the cover member is open, it is swung well forward of the base plate to expose the entire base plate surface and afford maximum clearance for mounting or removing the supply spool 16 and take-up spool 17 and for threading the ribbon 18 through the ribbon guides 12. When the cover member 51 is in its closed position, it has a front edge 55 generally vertically aligned with the front edge 37 of the base plate 36, and a rear margin 56 of the cover member has a part 57 which is vertically aligned with the portion of the base plate that has the upright latch finger 48, so that detent 49 of the latch finger may engage a notch 58 in the cover member while the part 57 of the cover rear margin 56 rests upon shoulders 48*a* of the finger 48 to support the cover member 51 in a generally horizontal position where it serves to confine the supply spool 16 and the take-up spool 17.**

The cover member has a first opening 59 which is seen in FIG. 1 to be aligned with the typewriter supply spool spindle 14; and the rear margin 56 is cut away to form a recess the inner end portion 61 of which forms an opening that is aligned with the end portion 44 of the elongate opening 43 in the base plate 36 when the cover member 51 is in its closed position. Small holes **45*a* and 46*a* respectively receive the upper ends of the pins 45 and 46. As best seen in FIG. 2, a manual ribbon feed knob 62 has a reduced portion 63 and a lower external flange 64; and the shaft portion 63 makes a snap fit in the portion 61 of the elongate opening 60 so as to be rotatable therein with the knob 62 above the cover member and the flange 64 below it. As best seen in FIG. 3 the lower end of the shaft 63 has a square socket 65 which receives a square upwardly extending boss 17*a* at the top of the take-up spool 17. The ribbon 18 is formed with a leader which is secured to the take-up spool 17, and when the leader is thus secured and the cover member 51 is moved to its closed position, the knob 62 may be manually turned to rotate the take-up spool 17 until the entire ribbon leader is past the right hand guide 12 seen in FIG. 1 and the ribbon is then ready for use. The typewriter is provided with a manual throw-out lever (not shown) which swings the drive roller 23 out of contact with the ribbon in order that an old supply spool 16 and take-up spool 17 may be removed from the spindles 14 and 15, respectively, and the new spools 16 and take-up spool 17** may be mounted on the respective spindles.

Figure 4:
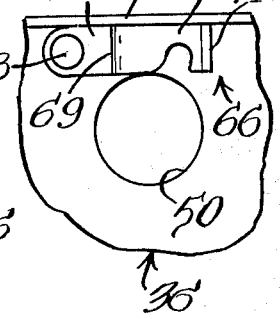
FIG. 4 is a fragmentary plan view illustrating the actuator for the control member in the position that it occupies when a total release ribbon is being used in the adapter.

The adapter 35 is also provided with an actuator, indicated generally at 66, by means of which the ribbon drive control means 31 may be moved to the position illustrated in FIGS. 1 and 2 in which the ribbon advance 19 is set for use with a ribbon of the plastic transfer matrix type. The actuator 66 consists of a one-piece metal member that has a base flange 67 pivotally secured to the base plate 36 adjacent the second opening 50 by means of a rivet 68. Extending upwardly from the flange 67 is a finger 69, and extending horizontally from the finger 69 is an overhanging member 70 which terminates in an upturned finger piece 71. When the actuating member 66 is in the position of FIG. 4, it is alongside the second opening 50 and clear of the ribbon advance control means 31. When the actuator 66 is pivoted to the position illustrated in FIGS. 1, 2 and 3, it overlies the spring cap 34. In that position it pushes down the spring cap and the compression spring 33, so as to move the change gears 27 and 28 to the position illustrated in FIG. 2 as the adapter is mounted upon the typewriter mounting plate 10 and engaged with the latch fingers 11.

As a rule, any particular typewriter is always used with only one kind of ribbon, so there is no need to shift the actuator 66 once the adapter has been mounted upon a typewriter. However, if it is desired to use any particular typewriter with both kinds of ribbon, it is a very simple matter to pivot the actuator 66 between the position of FIG. 4 and the position illustrated in the other figures of the drawings. It is not necessary to remove the adapter from the typewriter to move the actuator 66 from the position of FIG. 4 to the other position, because with the cover member 51 in its open position the drive control means may be readily depressed with the fingers of one hand and the actuator 66 may then be pivoted to its position with the overhanging element 70 overlying the spring cap 34.

Figure 5:
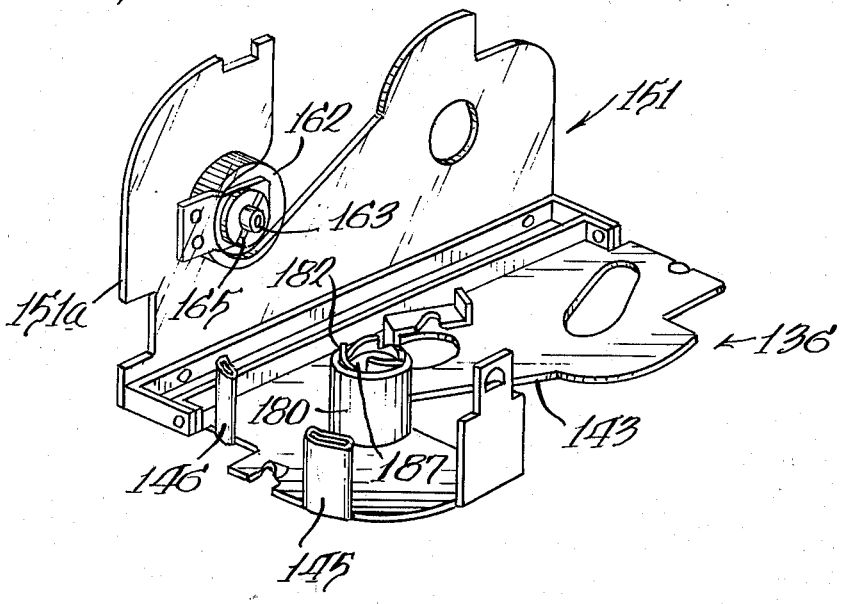
FIG. 5 is a view similar to FIG. 3 which illustrates a second embodiment of the invention.
Figure 6:
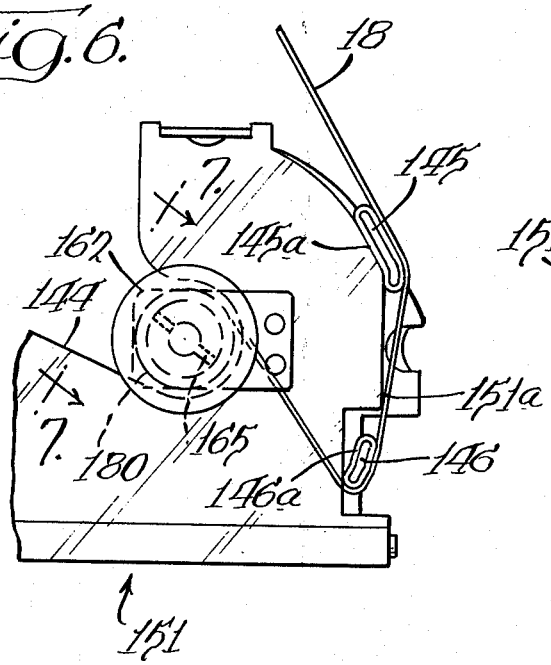
FIG. 6 is a fragmentary plan view on enlarged scale with the cover member closed.
Figure 7:
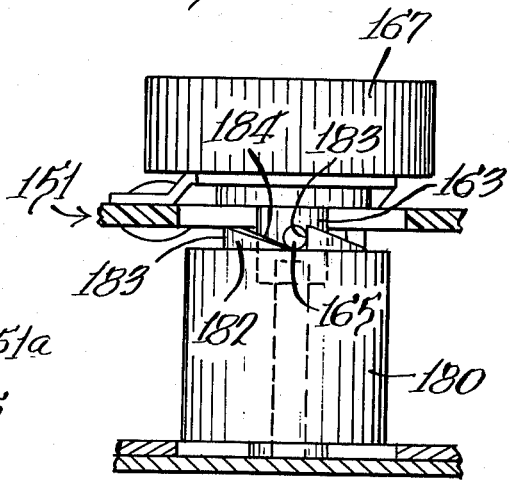
FIG. 7 is a fragmentary sectional view on an enlarged scale taken substantially as indicated along the line 7—7 of FIG. 6.

Referring now to the second embodiment of the invention which is illustrated in FIGS. 5 to 7, the detailed description will be directed principally to the respects in which the structure differs from the first embodiment, and corresponding parts of the second embodiment are indicated by reference numerals 100 higher than those for the first embodiment.

A base plate 136 has an elongate opening 143 and end portion 144 of which is adapted to receive a typewriter take-up spool spindle 15. Instead of the guide pins 45 and 46, the second embodiment of the invention has its base plate 136 provided with upturned marginal portions 145 and 146 around which a typewriter ribbon 18 is guided in the same way that it is guided around the pins 45 and 46 in the first embodiment.

The upturned portion 145 is seen to be substantially wider than the upturned portion 146, and both are outwardly convex so that a typewriter ribbon has curved surfaces around which it is guided. In addition, the outer surfaces of the upturned portions 145 and 146 are provided with anti-friction means which, in the particular embodiment illustrated is provided by plastic jackets **145*a* and 146*a*. However, it is apparent that the desired anti-friction characteristics of the ribbon contacting surfaces of the upturned portions 145 and 146 may be provided by a Teflon coating or by chromium plating. The plastic jacket is preferred, at least for the upturned portion 146, because the typewriter ribbon makes a relatively sharp bend around the forward margin of the element 146,** and the plastic jacket provides a smoothly rounded forward guide surface.

The surface of the upturned portion 145 that is contacted by the ribbon is considerably wider than the surface of the upturned portion 146 which is so contacted. The result is that the guide member 145 produces greater frictional drag upon the ribbon than does the guide member 146; and this is important because it eliminates any possibility of slack forming in the ribbon between the typewriter ribbon guides 12 and the ribbon guide 146 of the adapter. If, for example, the ribbon guide 146 afforded more frictional resistance than the ribbon guide 145, such slack could be formed and result in improper ribbon feed.

An adapter cover member 151 is hingedly mounted upon the base plate 146 in precisely the same way as is the cover member 51 of the first embodiment. However, elimination of the pins 45 and 46 eliminates the need for the holes **45*a* and 46*a*, and instead the cover member 151 is slightly shorter than the cover member 51 so that its end margin 151*a* is positioned inwardly of the upturned guide portions 145 and 146** when the cover member is in its closed position.

The only other difference between the first and second embodiments of the invention resides in the manual ribbon advance means. A ribbon feed knob 162 surmounts the cover member 151 and has a stub shaft 163 at its lower end which extends through an opening in the cover member. The stub shaft 163 is cylindrical, and spaced from its lower end is a cross pin 165 which acts as one part of a one-way clutch structure the purpose of which is to permit the knob 162 to be used to turn a ribbon take-up spool 180 only in a direction to wind ribbon upon the spool and thus prevent a person using the typewriter from inadvertently producing slack in the ribbon ahead of the take-up spool.

The take-up spool 180, like the take-up spool 17 of the first embodiment, is rotatably mounted upon a typewriter take-up spindle 15. The upper end of the spool 180 has a socket 187 to receive the lower end portion of the stub shaft 163, and surrounding the socket 181 is an annular array of teeth 182 which form the second part of the one-way clutch structure. Each of the teeth 182 includes a drive face 183 that is in a plane substantially on a radius of the stub shaft and parallel to the axis of the stub shaft; and each tooth also has a release face 184 which is at a very small angle from a plane perpendicular to the axis of the stub shaft 163. The cross pin 165 in the stub shaft 163 engages the drive faces 183 of the teeth 182 when the cover member 151 is closed and the knob 162 is turned in a direction to wind ribbon onto the take-up spool 180. Conversely, if the knob 162 is turned in the wrong direction, cover member 151 is sufficiently resilient to permit the pin 165 to ride over the release faces 184 of the teeth 182 so that the take-up spool 180 is not rotated.

The foregoing detailed description is given for clearness of understanding only and no unnecessary limitations should be understood therefrom, as modification will be obvious to those skilled in the art.

We claim:

1. An adapter for mounting a replaceable ribbon in a typewriter which has means to releasably retain a ribbon cartridge that contains a supply spool, a take-up spool, and a run of ribbon which extends outside the cartridge between said supply and take-up spools so that said run may be threaded through the typewriter ribbon guides, and which typewriter further has a supply spindle and take-up spindle that receive the supply spool and the take-up spool, respectively, said adapter comprising, in combination:

a rigid base plate which has a forward edge and a rear margin, said base plate being engageable by the retaining means of the typewriter to releasably mount the adapter in the typewriter, said base plate having a hole to receive the supply spindle and an opening which receives the take-up spindle, said base plate in the area surrounding the hole and in the area surrounding the opening being large enough to underlie a full ribbon supply spool and a full ribbon take-up spool, respectively;

a generally planar cover member which has a forward edge, a rear margin, a first cover opening and a second cover opening and has a closed position where it is effectively parallel to the base plate and in confining relationship to ribbon wound on spools above said base plate;

hinge means at the forward edges of the base plate and of the cover member mounting the cover member for pivotal movement about a transverse axis closer to the plane of the base plate, than to the plane of said cover said cover member in its closed position having its forward edge generally vertically aligned with the forward edge of the base plate, having a part of its rear margin generally vertically aligned with a portion of the rear margin of the base plate, and having its first and second cover openings vertically aligned, respectively, with the hole in the base plate and with said opening in the base plate, and pivotal movement of said cover member about said transverse axis swinging said cover member forwardly to expose effectively the entire base plate and the spools thereon;

and latch means comprising an upstanding finger on said portion of the rear margin of the base plate, and interengaging means at the upper end portion of said finger and at the rear of said part of the cover member to releasably retain the cover member in its closed position.

2. The combination of claim 1 in which the hinge means comprises a pair of short, upstanding ears at the ends of the base plate, aligned pivots in said ears close to the plane of the base plate, and depending fingers at the ends of the cover member which are mounted on said pivots.

3. The combination of claim 1 which includes a shallow, upright integral flange along the forward edge of the base plate.

4. The combination of claim 1 which includes fixed, upright ribbon guide means at an end marginal portion of the base plate adjacent the opening, said guide means being so positioned that the ribbon passes over the outer surface thereof as it approaches the take-up spool.

5. The combination of claim 4 in which the guide means includes a first guide member toward the rear of the base plate and a second guide member toward the front of the base plate, said first guide member producing greater frictional drag on the ribbon than does the second guide member to prevent slack in the ribbon ahead of the take-up spool.

6. The combination of claim 4 in which the ribbon guide means comprises an upturned marginal portion of the base plate around the outer surface of which the ribbon passes as it approaches the take-up spool.

7. The combination of claim 6 in which there is a first upturned portion of predetermined width toward the rear of the base plate and a second upturned portion of less width toward the front of the base plate, said upturned portions being outwardly convex from top to bottom.

8. The combination of claim 4 in which the cover member has a hole which is impaled by the upper extremity of the ribbon guide means when the cover is in its closed position.

9. The combination of claim 1 in which the ribbon guide means comprises a pair of spaced pins fixed in the base plate, and in which the cover member is provided with two holes that are impaled by the upper extremities of said pins when the cover member is in its closed position.

10. The combination of claim 1 in which the cover member is transparent.

11. An adapter for mounting a replaceable ribbon in a typewriter which has means to releasably retain a ribbon cartridge that contains a supply spool, a take-up spool, and a run of ribbon which extends outside the cartridge between said supply and take-up spools so that said run may be threaded through the typewriter ribbon guides, and which typewriter further has a supply spindle and a take-up spindle that rotatably receive the supply spool and the take-up spool, respectively, said adapter comprising, in combination:

a rigid base plate which has a forward edge and a rear margin, said base plate being engageable by the retainer means of the typewriter to releasably mount the adapter in the typewriter, said base plate having a hole to receive the supply spindle and an opening which receives the take-up spindle, said base plate in the area surrounding the hole and in the area surrounding the opening being large enough to underlie a full ribbon supply spool and a full ribbon take-up spool, respectively;

a generally planar cover member which has a forward edge, a rear margin, a first opening and a second opening;

means mounting the cover member in a closed position where it is effectively parallel to the base plate and in confining relationship to ribbon wound on spools above said base plate, said cover member in its closed position having its forward edge generally vertically aligned with the forward edge of the base plate, having a part of its rear margin generally vertically aligned with a portion of the rear margin of the base plate, and having its first and second openings vertically aligned, respectively, with the hole in the base plate and with said opening in the base plate, and said cover member being movable to expose effectively the entire base plate, said means mounting the cover member including latch means on the base plate which engages the cover member to releasably retain the cover member in its closed position;

a ribbon advance member rotatably mounted on the cover member in the second opening therein, said ribbon advance member including a finger piece above the cover member and having a lower end portion provided with take-up spool engaging means;

and a ribbon take-up spool the upper end portion of which is provided with means engaged by said engaging means so that rotation of the ribbon advance member rotates the take-up spool.

12. The combination of claim 11 in which the spool engaging means and the means at the upper end portion of the spool comprise one-way clutch means which restricts rotation of the spool to a direction which winds ribbon onto the spool.

13. The combination of claim 12 in which the lower end portion of the ribbon advance member comprises a depending stub shaft with a cross pin, and the means at the upper end portion of the stub shaft and shallow teeth surrounding the socket, said teeth having drive faces that are in planes substantially radial to the stub shaft and substantially parallel to the axis thereof and release faces at a small angle to the horizontal, the ribbon advance member being resiliently supported with reference to the spool so that the pin may ride over said faces if the advance member is not rotated in a direction to advance the ribbon.

14. The combination of claim 11 in which the advance member has a downwardly open, non-circular socket, and the take-up spool has a boss which is complementary to the socket.

15. An adapter for mounting a replaceable ribbon in a typewriter which has means to releasably retain a ribbon cartridge that contains a supply spool, a take-up spool, and a run of ribbon which extends outside the cartridge between said supply and take-up spools so that said run may be threaded through the typewriter ribbon guides, and which typewriter further has a supply spindle and a take-up spindle that rotatably receive the supply spool and the take-up spool, respectively, together with a ribbon drive roller that engages the outer surface of the ribbon on the take-up spool and moves in an arcuate path as ribbon winds onto the take-up spool, and a ribbon advance which adjusts for total release ribbon or plastic matrix ribbon and includes a vertically movable control member that is biased to an elevated first position, said adapter comprising, in combination:

a rigid base plate member which has a forward edge and a rear margin, said base plate member being engageable by the retaining means of the typewriter to releasably mount the adapter in the typewriter, said base plate member having a first hole to receive the supply spindle, an elongate opening an end portion of which receives the take-up spindlle and the rest of which accommodates the drive roller, and a second hole which receives the vertically movable ribbon advance control member, said base plate member in the area surrounding the first hole and in the area surrounding the elongate opening being large enough to underlie a full ribbon supply spool and a full ribbon take-up spool, respectively;

a generally planar cover member which has a forward edge, a rear margin, a first opening and a second opening;

means mounting the cover member in a closed position where it is effectively parallel to the base plate member and in confining relationship to ribbon wound on spools above said base plate member, said cover member in its closed position having its forward edge generally vertically aligned with the forward edge of the base plate member, having a part of its rear margin generally vertically aligned with a portion of the rear margin of the base plate member, and having its first and second openings vertically aligned respectively, with the hole in the base plate member and with said end portion of the elongate opening in the base plate member, and said cover member being movable to expose effectively the entire base plate member, said means mounting the cover member including latch means on the base plate member which engages the cover member to releasably retain the cover member in its closed position;

and an actuator for the ribbon advance control member, said actuator being mounted on one of said members for movement between an idle position alongside the control member and out of contact with said control member and an actuating position in which it bears upon the control member to depress said member from its elevated first position to a second position.

16. The combination of claim 15 in which the actuator is mounted on the base plate for frictionally inhibited turning movement about a vertical pivot which is adjacent the second hole in the base plate, and in which the actuator includes an upright stem and a generally horizontal arm that overhangs said second hole in the actuating position.

17. An adapter for mounting a replaceable ribbon in a typewriter which has means to releasably retain a ribbon cartridge that contains a supply spool, a take-up spool, and a run of ribbon which extends outside the cartridge between said supply and take-up spools so that said run may be threaded through the typewriter ribbon guides, and which typewriter further has a supply spindle and take-up spindle that receive the supply spool and the take-up spool, respectively, said adapter comprising, in combination:

a rigid base plate which has a forward edge and a rear margin, said base plate engageable by the retaining means of the typewriter to releasably mount the adapter in the typewriter, said base plate having a hole to receive the supply spindle and an opening which receives the take-up spindle, said base plate in the area surrounding the hole and in the area surrounding the opening being large enough to underlie a full ribbon supply spool and a full ribbon take-up spool, respectively;

a generally planar cover member which has a forward edge, a rear margin and a cover opening and has a closed position where it is effectively parallel to the base plate and in confining relationship to the ribbon wound on spools above said base plate;

hinge means at the forward edges of the base plate and of the cover member mounting the cover member for pivotal movement about a transverse axis closer to the plane of the base plate, said cover member having a closed position where it is effectively parallel to the base plate than to the plane of said cover and in said cover member in its closed position having its forward edge generally vertically aligned with the forward edge of the base plate, having a part of its rear margin generally vertically aligned with a portion of the rear margin of the base plate, and having its cover opening vertically aligned with said opening in the base plate, and pivotal movement of said cover member about said transverse axis swinging said cover member forwardly to expose effectively the entire base plate and the spools thereon;

and latch means comprising an upstanding finger on said portion of the rear margin of the base plate, and interengaging means at the upper end portion of said finger and at the rear of said part of the cover member to releasably retain the cover member in its closed position.

* * * * *